US009947438B2

(12) United States Patent
Truong et al.

(10) Patent No.: US 9,947,438 B2
(45) Date of Patent: Apr. 17, 2018

(54) LIGHTWEIGHT AND FLEXIBLE IMPACT RESISTANT POWER CABLE AND PROCESS FOR PRODUCING IT

(71) Applicant: PRYSMIAN S.P.A., Milan (IT)

(72) Inventors: Ryan Truong, Lexington, SC (US); Paul Cinquemani, Lexington, SC (US); Andrew Maunder, Lexington, SC (US); Chris Averill, Lexington, SC (US)

(73) Assignee: PRYSMIAN S.P.A., Milan (IT)

( * ) Notice: Subject to any disclaimer, the term of this patent is extended or adjusted under 35 U.S.C. 154(b) by 0 days.

(21) Appl. No.: 15/023,937

(22) PCT Filed: Sep. 23, 2013

(86) PCT No.: PCT/IB2013/002426
§ 371 (c)(1),
(2) Date: Mar. 22, 2016

(87) PCT Pub. No.: WO2015/040448
PCT Pub. Date: Mar. 26, 2015

(65) Prior Publication Data
US 2016/0233007 A1 Aug. 11, 2016

(51) Int. Cl.
*H01B 7/18* (2006.01)
*H01B 13/14* (2006.01)
(Continued)

(52) U.S. Cl.
CPC ..... *H01B 7/18* (2013.01); *H01B 3/441* (2013.01); *H01B 3/443* (2013.01); *H01B 3/445* (2013.01);
(Continued)

(58) Field of Classification Search
CPC ..... H01B 7/18; H01B 3/441; H01B 3/443; H01B 3/445; H01B 7/0225; H01B 7/189;
(Continued)

(56) References Cited

U.S. PATENT DOCUMENTS 4,675,474 A * 6/1987 Neuroth ..... H01B 7/046 156/51
5,089,329 A * 2/1992 de Vrieze ..... H01B 7/282 174/107
(Continued)

FOREIGN PATENT DOCUMENTS

CN 1255229 5/2000
CN 1419698 5/2003
(Continued)

OTHER PUBLICATIONS

Notification of the First Office Action from the State Intellectual Property Office of the People's Republic of China, in counterpart Chinese Application No. 201380080337.1 dated Dec. 12, 2016.
(Continued)

*Primary Examiner* — Steven T Sawyer
(74) *Attorney, Agent, or Firm* — Finnegan, Henderson, Farabow, Garrett & Dunner, L.L.P.

(57) ABSTRACT

The present disclosure relates to an impact resistant, multi-polar power cable (10) comprising, a plurality of cores (1), each core (1) comprising at least one conductive element (3) and an electrical insulating layer (5) in a position radially external to the at least one conductive element (3). The cores (1) are stranded together so as to form an assembled element providing a plurality of interstitial zones (2). An expanded polymeric filler (6) fills the interstitial zones (2) between the plurality of cores (1). An expanded impact resistant layer (7) is in a position radially external to the expanded polymeric
(Continued)

filler (6) and comprises a polymer that differs from the expanded polymeric filler (6).

14 Claims, 2 Drawing Sheets

(51) Int. Cl.
*H01B 7/295* (2006.01)
*H01B 3/44* (2006.01)
*H01B 7/02* (2006.01)
*H01B 9/00* (2006.01)
*H01B 13/24* (2006.01)

(52) U.S. Cl.
CPC ..... *H01B 7/0225* (2013.01); *H01B 7/189* (2013.01); *H01B 7/295* (2013.01); *H01B 9/006* (2013.01); *H01B 13/141* (2013.01); *H01B 13/142* (2013.01); *H01B 13/24* (2013.01)

(58) Field of Classification Search
CPC ..... H01B 7/295; H01B 9/006; H01B 13/141; H01B 13/142; H01B 13/24
See application file for complete search history.

(56) References Cited

U.S. PATENT DOCUMENTS

| | | | | |
|---|---|---|---|---|
| 5,153,381 | A | 10/1992 | Ganatra et al. | |
| 6,501,027 | B1 | 12/2002 | Belli et al. | |
| 7,132,604 | B2 | 11/2006 | Scheidecker et al. | |
| 7,465,880 | B2 | 12/2008 | Belli et al. | |
| 7,601,915 | B2 | 10/2009 | Lumachi et al. | |
| 2003/0079903 | A1 | 5/2003 | Scheidecker et al. | |
| 2003/0141097 | A1 | 7/2003 | Belli et al. | |
| 2004/0065456 | A1* | 4/2004 | Belli | H01B 7/288 174/25 R |
| 2005/0137290 | A1* | 6/2005 | Hagen | C08L 53/02 523/219 |
| 2009/0071692 | A1 | 3/2009 | Belli et al. | |
| 2010/0252299 | A1 | 10/2010 | Kummer et al. | |
| 2013/0068497 | A1* | 3/2013 | Cinquemani | H01B 7/2813 174/105 R |

FOREIGN PATENT DOCUMENTS

| | | |
|---|---|---|
| CN | 1480958 | 3/2004 |
| CN | 1585989 | 2/2005 |
| CN | 102097174 | 6/2011 |
| CN | 202003746 | 10/2011 |
| CN | 202332365 | 7/2012 |
| CN | 202352406 | 7/2012 |
| EP | 0 981 821 | 12/2008 |
| RU | 2374707 C2 | 11/2009 |

OTHER PUBLICATIONS

International Search Report from the European Patent Office for International Application No. PCT/IB2013/002426, dated May 15, 2014.

Notification of the Search Report from Federal institute of industrial property in counterpart Russian Application No. 2016115550/07 dated Aug. 17, 2017.

* cited by examiner

LIGHTWEIGHT AND FLEXIBLE IMPACT RESISTANT POWER CABLE AND PROCESS FOR PRODUCING IT

BACKGROUND OF THE INVENT ON

1. Field of the invention

The present disclosure relates to multipolar power cables, particularly for the transport or distribution of low, medium, or high voltage electrical power, having impact resistant properties, and to a process for the production thereof.

More particularly, the present disclosure relates to impact resistant multipolar power cables comprising a plurality of cores stranded to form an assembled element with interstitial zones between the cores; an expanded polymeric filler that fills the interstitial zones; and an impact resistant, expanded polymeric layer radially external to and in contact with the expanded polymeric filler.

2. Background

Within the scope of the present disclosure, "low-voltage" generally means a voltage less than about 1 kV, "medium-voltage" means a voltage between 1 kV and 35 kV, "high-voltage" means a voltage greater than 35 kV.

Electrical cables generally comprise one or more conductors, individually coated with insulating and, optionally, semiconductive polymeric materials, and one or more protective coating layers, which can also be made of polymeric materials.

Accidental impacts on a cable, which may occur, for example, during their transportation, laying and operation, may cause structural damage to the cable, including deformation or detachment of insulating and/or semiconductive layers, and the like. This damage may cause variations in the electrical gradient of the insulating coating, with a consequent decrease in the insulating capacity of this coating.

Commercially available cables, for example those for low- or medium- or high-voltage power transmission or distribution, provide metal armour or shield capable of withstanding such impacts. This armour/shield may be in the form of tapes or wires (generally made of steel), or alternatively in the form of a metal sheath (generally made of lead or aluminium). This armour with or without an adhesive coating is, in turn, often clad with an outer polymer sheath. An example of such a cable structure is described in U.S. Pat. No. 5,153,381.

Applicants have observed that the presence of the above mentioned metal armour or shield, however, has a certain number of drawbacks. For example, the application of the said armour/shield includes one or more additional phases in the processing of the cable. Moreover, the presence of the metal armour increases the weight of the cable considerably. In addition, the metal armour/shield may pose environmental problems since, if it needs to be replaced, a cable constructed in this way is not easy to dispose.

To make more light weight and flexible cables, expanded polymeric materials have replaced metal armour/shields while still maintaining impact and, at least to a certain degree, flame and chemical resistance. For example, a solid interstitial filler overlaid with an expanded polymeric layer may provide excellent impact resistance, such as described in U.S. Pat. No. 7,601,915. However, flexibility and weight of the cable is sacrificed.

Alternatively, an expanded polymeric material may fill the interstitial volume between and overlay the core elements present in the inner structure of the cable. U.S. Pat. No. 6,501,027 describes a power cable comprising an expanded polymeric filler in the interstitial volume between the cores with an outer sheath coating. The expanded polymeric filler is obtained from a polymeric material which has, before expansion, a flexural modulus higher than 200 MPa. The polymer is usually expanded during the extrusion phase; this expansion may either take place chemically, by means of a compound capable of generating a gas, or may take place physically, by means of injection of gas at high pressure directly into the extrusion cylinder. The outer sheath, which is a non-expanded polymeric layer, is subsequently extruded over the expanded polymeric filler.

U.S. Pat. No. 7,132,604 describes a cable with a reduced weight and a reduced amount of extruded material for the outer sheath and comprising a polymeric material filler and an expanded sheathing material surrounding the filler. The expanded sheathing material can be any material that has a tensile strength between 10.0 MPa and 50.0 MPa. The expansion rate of the sheathing material can be from 5% to 50%. The material of filler can be a material on the basis of polyvinylchloride, rubber, EPDM (Ethylene Propylene Terpolymer) or POE (Poly Olefin Elastomer). The filler can be made of expanded material. The expansion rate of the filler can be from 10% to 80%.

U.S. Pat. No. 7,465,880 teaches that applying an expandable polymeric material to the interstitial zones of a multipolar cable is a complex operation which requires special care. An incorrect application of such material inside of the interstitial zones of the assembled element will result in the occurrence of unacceptable structural irregularities of the cable. The polymeric material, which is applied to the interstitial zones by extrusion, expands more in the portion of the interstitial zone that has the most space available to expand and the resulting transverse cross section of the semi-finished cable has an external perimetral profile which is substantially trilobate.

To overcome the non-uniform and non-circular expansion of polymeric filler, U.S. Pat. No. 7,465,880 teaches to deposit the filler made of expandable polymeric material by co-extrusion with a containment layer of non-expanded polymeric material. An optimum mechanical strength against accidental impacts is conferred to the cable of U.S. Pat. No. 7,465,880 by arranging a layer of expanded polymeric material in a position radially external to the containment layer.

U.S. Patent Application Publication No. 2010/0252299 describes a cable comprising a conductor core, a polymeric material filler and an armour layer. A foaming agent may be configured to create voids in the filler. After being extruded onto the conductor core, the filler may have a squeezing force applied to its exterior by armour. The armour is configured to squeeze the voids in the filler.

SUMMARY OF THE INVENTION

The Applicants perceived a need for a lightweight and flexible multipolar power cable, particularly a fire-retardant multipolar power cable with suitable impact resistance, yet without a containment layer. The use of a containment layer may further require an additional expanded polymer layer to provide the desired impact resistance thus adding to the expense, complexity and increased dimensions of the resulting cable.

However, Applicants faced the problem of manufacturing a cable having an expanded polymeric filler for the interstices and an expanded impact resistant layer radially external to and in contact with the expanded polymeric filler. In particular, the Applicants faced problems in the co-extrusion of these two expanded cable portions in that the expansion of the polymeric filler for the interstices should be as uniform as possible to avoid shape and surface irregularities that cannot be counteracted by the impact resistant layer, which could not play a role of containment layer as it is expanded.

The polymeric composition of the filler for the interstices should be different from that of the impact resistant layer. While both structures should be endowed of a significant mechanical resistance, the filler for the interstices plays a major role in providing flexibility to the cable; accordingly its polymeric composition should be less stiff than that of the impact resistant layer which should bear the major stress in case of mechanical shock. In addition, when the two layers are made of the same material, problems arise at the interface thereof due to an undesirable bonding between the layers.

Applicants have found that by the proper selection of expandable polymeric materials, the filler for the interstices between and over the core elements may be coextruded with the impact resistant layer while maintaining cable concentricity and impact resistance on expansion.

Thus, one aspect of the present disclosure provides an impact resistant multipolar power cable comprising:

a) a plurality of cores, each core comprising at least one conductive element and an electrical insulating layer in a position radially external to the at least one conductive element, the cores being stranded together so as to form an assembled element providing a plurality of interstitial zones;

b) an expanded polymeric filler filling the interstitial zones, and comprising a polymer with a shore D hardness ranging from 30 to 70, a flexural modulus of from 50 MPa to 1500 MPa at 23° C., and a LOI of from 27 to 95% before expansion;

c) an impact resistant layer in a position radially external to and in contact with the expanded polymeric filler, wherein the layer comprises an expanded polymer that differs from the polymer of the filler and has, before expansion, a flexural modulus greater than that of the polymer for the filler; and d) a solid polymeric jacket surrounding the impact resistant layer.

In another aspect the present disclosure provides a process for producing an impact resistant multipolar power cable comprising a plurality of cores, each core comprising at least one conductive element and an electrical insulating layer in a position radially external to the at least one conductive element, the cores being stranded together so as to form an assembled element providing a plurality of interstitial zones; an expanded polymeric filler filling the interstitial zones; an impact resistant layer in a position radially external to and in contact with the expanded polymeric filler; and a solid polymeric jacket surrounding the impact resistant layer, the processing comprising a) providing to an extruder a first polymer material with a shore D hardness ranging from 30 to 70, a flexural modulus of from 50 MPa to 1500 MPa at 23° C., and a LOI of from 27 to 95% for producing the expanded polymeric filler;

b) providing to an extruder a second polymer material for producing the impact resistant layer, said second polymer a flexural modulus greater than that of the first polymer c) adding a foaming agent to the first and second polymer material, the foaming agent for at least the first polymer comprising thermally expandable microspheres:

d) triggering the foaming agent of the first and second polymer material to expand the relevant polymer;

e) coextruding the expanded first and second polymer material to form the polymeric filler filling the interstitial zones and the impact resistant layer; and f) extruding a solid polymeric jacket around the impact resistant layer.

A balancing of the Shore D hardness, flexural modulus, and LOI properties for the polymer of the expanded polymeric filler has been found effective to provide the cable with advantageous properties. Higher shore D hardness and flexural modulus improve impact resistance of the overall cable. However, if impact resistance is too high, the cable will be too stiff, not as flexible as desired. By expanding the polymer, the cable is more flexible. As used herein and in the claims, the Shore D hardness, flexural modulus, and LOI refer to properties of the polymer before being expanded. As used herein, and unless otherwise specified, the term "LOI" refers to limited oxygen index, i.e., the minimum concentration of oxygen, expressed as a percentage that will support combustion of a polymer. As used herein and in the claims, Shore D hardness, flexural modulus, and LOI refer to properties as determined by ASTM D2240, ASTM D790, and ASTM D2863, respectively.

As used herein, an interstitial zone is the volume included among two stranded cores and the cylinder enveloping the stranded cores.

As used herein, as impact resistant layer is meant a cable layer providing the cable with the capacity of suffering null or negligible damage under impact so that the cable performance is not impaired or lessened.

Applicants have found that by using thermally expandable microspheres as a foaming agent for at least the polymeric filler for the interstices, the filler may be co-extruded with an expandable polymeric layer while maintaining its concentricity and impact resistance on expansion.

Thus, in one embodiment, at least the polymeric filler for the interstices contains expanded microspheres. In yet another embodiment, the foaming agent added to the second polymer material comprises thermally expandable microspheres and the impact resistant layer of the cable also comprises expanded microspheres. The use of microsphere allows a better control of the expansion and, as a consequence, a better circularity of the final cable.

Advantageously, the polymer material for the filler of the interstitial zones (first polymer material) is selected among polyvinylchloride (PVC), polyvinylidene fluoride (PVDF), thermoplastic vulcanizates (TPV), flame retardant polypropylene, and thermoplastic olefins (TPO). TPOs suitable for the present disclosure include, but are not limited to, low crystalline polypropylene (having a melting enthalpy lower than 40 J/g) and alpha-olefin polymer. In one embodiment, the polymer material for the filler of the interstitial zones is selected among polyvinylchloride and polyvinylidene fluoride.

As used herein, and unless otherwise specified, the term "thermoplastic vulcanizates" or TPV refers to a class of thermoplastic elastomer (TPE) that contains a cross linked rubber phase dispersed within a thermoplastic polymer phase. In one embodiment, the TPV suitable for the cable filler of the invention contains an amount of cross linked rubber phase of from 10 wt % to 60 wt % with respect to the polymer weight.

As used herein, and unless otherwise specified, the term "thermoplastic elastomer" or TPE relates to a class of copolymers or a physical mix of polymers (usually a plastic and a rubber) which consist of materials with both thermoplastic and elastomeric properties.

The polymer material of the interstitial filler can reach an expansion degree of 15-200%, such as of 25-100%. A limited expansion degree of the polymeric material of the interstitial filler is conducive for maintaining the cable circularity, while endowing the cable with the sought flexibility and reduced weight.

In one embodiment, the expanded polymer material of the interstitial filler extends beyond and overlays the plurality of cores and interstitial zones, such that an annular ring surrounds the plurality of cores and interstitial zones. This extension of the interstitial filler over the core (also referred to as annular layer) can have a thickness of about 1 mm to about 6 mm. Greater thickness of this annular ring may be envisaged depending on the cable size.

Advantageously, the polymer material for the impact resistant layer (second polymer material) is selected among polyvinylidene fluoride (PVDF), flame retardant polyprolylene (PP) and polyethylene (PE). In one embodiment, the polymer material for the impact resistant layer is selected among polyvinylidene fluoride and polyprolylene. Notably, PVC and PVDF are flame retardant polymers. Polypropylene and polyethylene are imparted with flame retardant properties by the addition of organic flame retardant compounds, for example brominated flame retardants such as decabromodiphenyl ether, propylene dibromo styrene, hexabromocyclododecane or tetrabromobisphenol A.

In at least one embodiment, one or more ripcords are disposed in the interstitial zones. The one or more ripcords can be made of a material chosen from, for example, fiber, glass, and aramid yarn.

BRIEF DESCRIPTION OF THE DRAWING

Further details will be illustrated in the following, appended drawing, wherein.

DETAILED DESCRIPTION

The power cables of the present disclosure are multipolar cables. For the purposes of the present description, the term "multipolar cable" means a cable provided with at least a pair of "cores." For example, if the multipolar cable has three cores, the cable is known as a "tripolar cable".

As used herein, and unless otherwise specified, the term "core" relates to a conductive element (typically made of copper or aluminium in form of wires or rod), an electrical insulation and, optionally, at least one semiconducting layer, typically provided in radial external position with respect to the electrical insulating layer. A second (inner) semiconducting layer can be present and typically provided between the electrical insulating layer and the conductive element. A metal screen, in form of wires or braids or tapes of conductive metal can be provided as outermost core layer.

Figure 1:
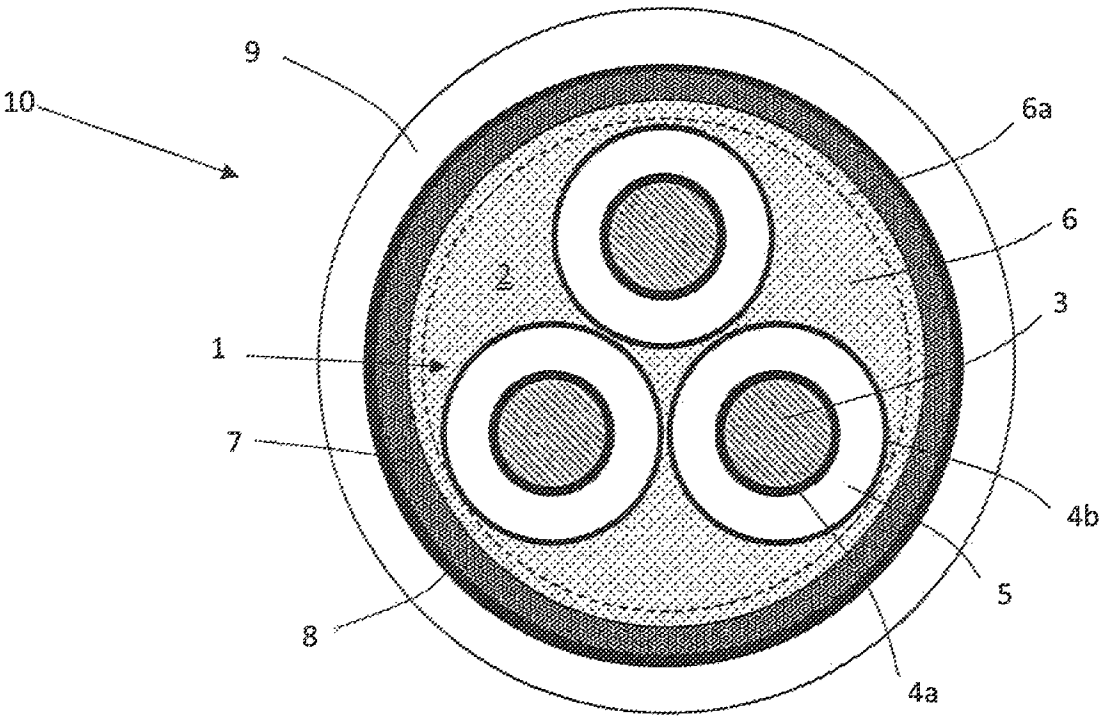
FIG. 1 shows, in cross-section, an embodiment of a cable according to the present disclosure.

FIG. 1 illustrates a sketched view of a transversal cross-section of a tripolar cable according to an embodiment of the present disclosure. This cable (10) contains three cores (1) and three interstitial zones (2). Each core (1) comprises a conducting element (3), an inner semiconducting layer (4*a*), an electrical insulating layer (5), which may be crosslinked or not, and an outer semiconducting layer (4*b*).

The three cores (1) are stranded together forming interstitial zones (2) defined as the spaces between the cores (1) and the cylinder enveloping such cores. The external perimetral profile of the stranded cores cross-section is, in the present case, trilobate as there are three cores.

An expanded polymeric filler (6) fills the interstitial zones (2) interdisposed between the cores (1). The expanded polymeric filler (6) extends beyond and overlays the stranded cores (1) and interstitial zones (2) as defined by annular region (6*a*).

Figure 2:
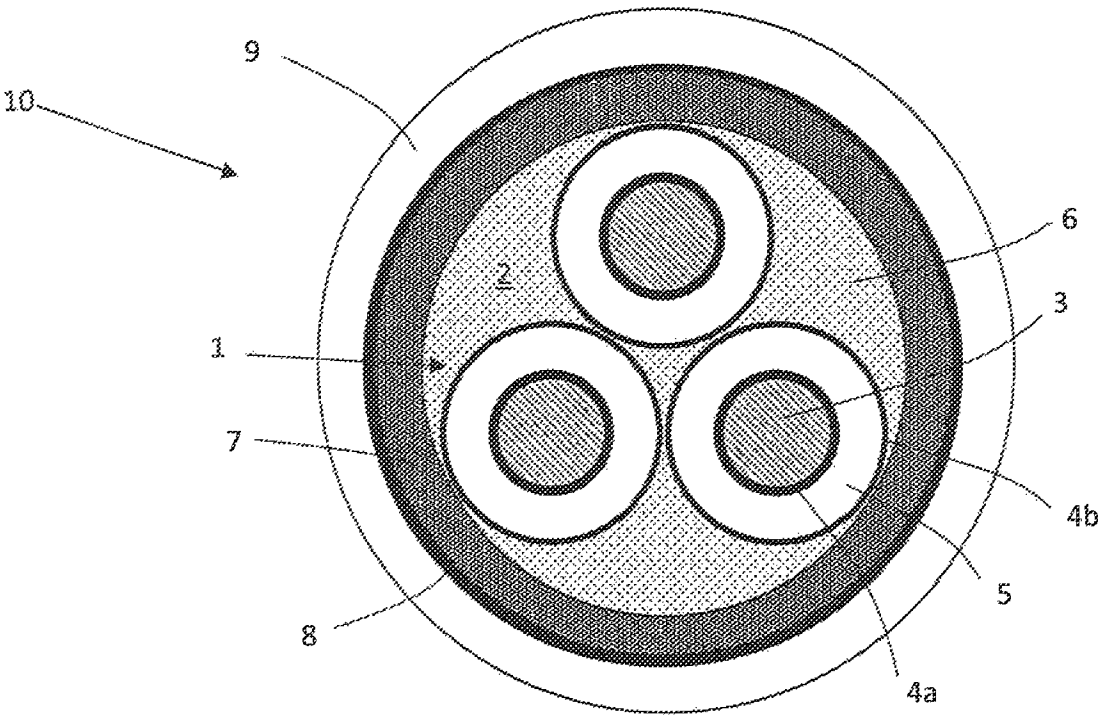
FIG. 2 shows, in cross-section, another embodiment of a cable according to the present disclosure.

Alternatively, as shown in FIG. 2, the polymeric filler (6) only fills the interstitial zones (2) interdisposed between the stranded cores (1). It does not form any significant annular layer overlaying the interstitial zones (2) and the stranded cores (1).

In order to confer a multipolar cable with a suitably substantially circular transversal cross-section, the expanded polymeric filler expands to fill and, optionally, overlays the interstitial zones and the cores.

The expanded polymeric filler (6, 6*a*) is surrounded by and in contact with an expanded impact resistant layer (7).

As used herein, and unless otherwise specified; the term "expanded" refers to a polymer wherein the percentage of "void" volume is typically greater than 10% of the total volume of said polymer. As used herein, and unless otherwise specified, the term "void" refers to the space not occupied by the polymer but by gas or air. A not-expanded polymer is also referred to as "solid".

As used herein, and unless otherwise specified, the term "expansion degree" refers to the percentage of free space in an expanded polymer. The expansion degree of an expanded polymer may be defined according to the following equation:

$$G=(d_0/d_e-1)\times 100$$

wherein $d_0$ indicates the density of the unexpanded polymer and $d_e$ represents the measured apparent density of the expanded polymer.

The expanded polymeric filler (6) and impact resistant layer (7) were selected to meet the earlier discussed requirements. The cable (10) lacks a solid containment layer in contact with the expanded polymeric filler (6) and capable of providing the filler with the desired circularity.

The cable (10) of FIGS. 1 and 2 are further provided with an optional metal (e.g. aluminium or copper) or metal/polymer composite (e.g. aluminium/polyethylene) layer (8) with overlapping edges (not shown) and an adhesive coating (not shown). The layer (8) can act as water or moisture barrier, has a thickness typically of from 0.01 mm to 1 mm, and has a negligible or null performance as impact resistant layer.

A polymeric jacket (9), typically made of PE, PVC or chlorinated polyethylene optionally added with anti-UV additives, is provided, such as by extrusion, as the outermost cable layer. The polymeric jacket has a thickness typically of from 1.0 mm to 3.0 mm or more, depending on the cable size.

Optionally, cable (10) further comprises a chemical barrier (not illustrated) in the form of a polymeric layer provided in radially internal position with respect to the jacket (9) and in radially external position with respect to the expanded impact resistant layer (7). For example, the chemical barrier may be as disclosed in U.S. Pat. No. 7,601,915. The barrier may comprise at least one polyamide and copolymers thereof, such as a polyamide/polyolefin blend, or TPE, and have an exemplary thickness of 0.5 mm to 1.3 mm. In at least one embodiment, when the impact resistant layer is made of PVDF, it can also perform as chemical barrier layer without changing the thickness, thus providing a cable with reduced diameter. In another embodiment, the chemical barrier layer is a polyimide.

The expansion to form an expanded polymer filler and of the expanded impact resistant layer takes place during extrusion, more specifically before the polymeric material passes through the extrusion die. Expansion of the impact resistant layer may be by chemical agents, e.g., through the addition to the polymeric composition of a suitable expanding agent, which is capable of producing a gas under specific temperature and pressure conditions. Examples of suitable expanding agents are: azodicarbamide, paratoluene sulphonylhydrazide, mixtures of organic acids (citric acid for example) with carbonates and/or bicarbonates (sodium bicarbonate for example), and the like.

In another embodiment, expansion to form an expanded impact resistant layer may take place due to microspheres that may be chosen from thermally expandable microspheres. The expansion of the polymer filler is carried out by thermally expandable microspheres. Thermally expandable microspheres are particles comprising a shell (typically thermoplastic) and a low-boiling point organic solvent encapsulated therein. With increasing temperature, the organic solvent vaporizes into a gas which expands to produce high internal pressures. At the same time, the shell material softens with heating so the whole particle expands under the internal pressure to form large bubbles. The microspheres have relative shape stability and do not retract after cooling. A suitable example of a thermally expandable microsphere is the commercial product sold under the name Expancel® from Eka Chemicals.

The polymer material is substantially fully expanded while it is still in the extruder crosshead and no significant expansion of the material occurs after it exits the extrusion die. This allows for controlled expansion with a circular cross-section.

The use of thermally expandable microsphere as foaming agent was found particularly suitable for expanding the polymeric filler, while the choice of the foaming agent for the impact resistant layer is less critical. In one embodiment, the thermally expandable microspheres are used in both the polymeric filler and the impact resistant layer.

According to the present disclosure, the polymer suitable for the interstitial filler has a shore D hardness ranging from 30 to 70, a flexural modulus (at 23° C. according to ASTM D 790) ranging from 50 MPa to 1500 MPa, and a limiting oxygen index (LOI) ranging from about 25% to 95%. As polymer properties may differ when expanded or non-expanded, the properties of the polymeric material are measured before expansion.

Examples of the polymer suitable for the interstitial filler include, but are not limited to thermoplastic polymers selected, for example, from thermoplastic vulcanizates (TPV), thermoplastic olefins (TPO), flame retardant polypropylene, polyvinylchloride (PVC), polyvinylidene fluoride (PVDF), and combinations thereof. Flame retardant polypropylene comprises added halogenated (e.g. brominated) flame retardant organics, as already mentioned above. Thermoplastic polyurethane and thermoplastic polyester elastomers are unsuitable as expandable material for the interstitial filler and impact resistant layer of the cable of the invention. Thermoplastic polyurethane and some thermoplastic polyester elastomers showed poor flame retardancy, while other thermoplastic polyester elastomers were found very difficult to be properly expanded.

A non-limiting example of a TPV is Santoprene™ available from Exxon Mobil. Non-limiting examples of TPO's include polymers that are available from DuPont, Heraflex® TPC-ET polymers available from RadiciPlastics.

As used herein, and unless otherwise specified, the term "containment layer" refers to non-expanded layer, whether polymeric or otherwise, that functions to maintain the concentricity of the expanded polymeric filler surrounding cores of a multipolar cable. Without being limited to a particular theory, expanded layers are incapable of maintaining the concentricity of an expanded polymeric filler.

In at least one embodiment, the polymer suitable for the interstitial filler reaches an expansion degree ranging from 15% to 200%, for example from 25% to 100%. The expanded polymeric filler expands to fill the interstitial zones and, optionally, to overlay and protect the plurality of cores. In at least one embodiment, the filler overlays the plurality of cores and the interstitial zones with a thickness of from about 0.5 mm to about 6 mm, yielding a substantially circular cross-section.

According to the present disclosure, the impact resistant layer is not a containment layer but an expanded polymeric layer. The polymer suitable for the impact resistant layer has a flexural modulus higher than that of the polymer in the interstitial filler. The flexural modulus of the impact resistant layer can ranges from 500 to 2500 MPa.

Examples of the polymer in the impact resistant layer include, but are not limited to polyvinylidene fluoride (PVDF), polyprolylene (PP), such as ethylene-propylene copolymer, and polyethylene (PE), and mixtures thereof. In one embodiment the polymer is an ethylene-propylene copolymer.

A non-limiting example of polyethylene (PE) is low density PE (LDPE), medium density PE (MDPE), high density PE (HDPE), linear low density PE (LLDPE), ultra-low density-polyethylene (ULDPE).

In at least one embodiment, the polymer suitable for the impact resistant layer reaches an expansion degree ranging from 20% to 200%, for example from 20% to 50%.

In at least one embodiment, the expanded polymeric filler and the impact resistant layer are made from different polymeric materials. In particular, the material for the expanded impact resistant layer has a flexural modulus higher than that of the material for the interstitial filler.

The cables according to the present disclosure may be produced by any well-known methods of manufacture for multipolar cables. The polymeric filler and the impact resistant layer are provided to surround the stranded cable cores by co-extrusion or by tandem extrusion.

Preferably coextrusion of interstitial filler and impact resistant layer materials—having different processing temperatures—is carried out in a single extrusion crosshead by pressure extrusion for the interstitial filler and sleeving extrusion for the impact resistant layer.

Illustrative, non-limiting, examples are given herein-below in order to describe the present disclosure in further detail.

EXAMPLES

Preparation of Cables with Expanded Filler

A series of tripolar cables according to the present disclosure as well as comparatives were constructed. These cables are identified in the following text by the letters A to R and are detailed in Table 1. For each of cable A to R, a triplexed core was insulated with cross-linked polyethylene (XLPE). The cable construction is specified in Table 1.

Comparative cables E and F were prepared based on known cable designs. Cable E has no filler, just an impact resistant layer in form of metallic armour (Mylar tape surrounded by a welded aluminium armour) surrounded by a PVC jacket, extruded over the cable core to complete the construction. Cable F has a solid PVC filler extruded over the triplexed core. While Cable F has an impact resistant layer in form of corrugated aluminium armour and an overall PVC jacket, extruded over the cable core to complete the construction.

TABLE 1

| Cable | Insulated Core | Filler | Impact Resistant layer | Metallic layer | Chemical barrier | Jacket |
|---|---|---|---|---|---|---|
| | Cable Construction | | | | | |
| A | 3 × 5.3 $mm^2$ + 0.8 mm XLPE | PVC + 3% fE 1.1 mm overlaid G = 75% | $PVDF^1$ + 3% fE 1 mm G = 32% | — | yes | PVC 1.6 mm |
| B | 3 × 107 $mm^2$ + 2 mm XLPE | PVC + 2% fE 2.5 mm overlaid G = 75% | PP + 0.65% fH 1.7 mm G = 33% | — | — | PVC 2.8 mm |
| C | 3 × 107 $mm^2$ + 2 mm XLPE | PVC + 2% fE 4.1 mm overlaid G = 75% | PP + 0.8% fH 1.7 mm G = 33% | — | PA 1.2 mm | PVC 2.8 mm |
| D | 3 × 107 $mm^2$ + 2 mm XLPE | PVC + 3% fE 2.5 mm overlaid G = 75% | PP + 0.8% fH 1.7 mm G = 33% | Polylam | PA 1.2 mm | PVC 2.8 mm |
| E* | 3 × 5.3 $mm^2$ + 0.8 mm XLPE | — | — | Welded Al armor | — | PVC 1.6 mm |
| F* | 3 × 5.3 $mm^2$ + 0.8 mm XLPE | PVC (solid) | — | Corrugated Al armor | — | PVC 1.6 mm |
| M | 3 × 5.3 $mm^2$ + 0.8 mm XLPE | TPV + 3% fE 2 mm overlaid G = 66% | $PVDF^2$ 0.8% fE 1.3 mm G = 31% | — | yes | PVC 1.6 mm |
| N | 3 × 5.3 $mm^2$ + 0.8 mm XLPE | PVC + 3% fE 1.2 mm overlaid G = 75% | PP + 1.5% fE 1 mm G = 37% | — | PA 0.7 mm | PVC 1.7 mm |
| O | 3 × 5.3 $mm^2$ + 0.8 mm XLPE | PVC + 3% fE 1.1 mm overlaid G = 75% | PP + 1.5% fE 1 mm G = 37% | — | TPE 0.6 mm | PVC 1.6 mm |
| P | 3 × 5.3 $mm^2$ + 0.8 mm XLPE | PVC + 3% fE 1.1 mm overlaid G = 75% | PP + 1.5% fE 1.2 mm G = 37% | — | PVDF 0.7 mm | PVC 1.7 mm |
| Q | 3 × 5.3 $mm^2$ + 0.8 mm XLPE | PVC + 3% fE + skin (0.13 mm) 1 mm overlaid G = 75% | $PVDF^1$ + 3% fE 1.1 mm G = 32% | — | yes | PVC 1.5 mm |
| S* | 3 × 107 $mm^2$ + 2 mm XLPE | TPE + 7% fE + skin (0.7 mm) 3.4 mm overlaid G = 254% | PP + 0.65% fH 1.7 mm G = 33% | — | — | PVC 2.8 mm |

*Comparative cables
G = expansion degree
PVC (filler) = polyvinylchloride (Shore D = 40, Flexural Modulus @ 23° C. = 70 MPa, LOI = 28.5%)
TPV = thermoplastic vulcanizates (Shore D = 32, Flexural Modulus @ 23° C. = 152 MPa, LOI = 27%)
$PVDF^1$ = polyvinylidene fluoride (Shore D = 54, Flexural Modulus @ 23° C. = 356 MPa; LOI = 42%)
$PVDF^2$ = polyvinylidene fluoride (Shore D = 46, Flexural Modulus @ 23° C. = 607 MPa; LOI = 42%)
PP = polypropylene (Shore D = 55, Flexural Modulus @ 23° C. = 475 MPa LOI = 42%)
TPE = thermoplastic polyethylene (Shore D = 44; Flexural Modulus @ 23° C. = 145 MPa; LOI= 26%)
fE = microsphere foaming agent (AkzoNobel Expancel ®)
fH = citric acid foaming agent
Polylam = aluminum/polyethylene laminate as moisture barrier (it does not impart any impact resistance)
skinP = Polyvinylchloride skin
skinH- thermoplastic polyethylene skin
PA = Polyamide
PVC (jacket) = Polyvinylchloride In cables A, M and Q, the impact resistance layer also performs as a chemical barrier.

Skin present in cable Q and S is a layer co-extruded with filler to provide a better surface on the filler. The skin does not provide a containment function.

The filler/impact resistant layer co-extrusion of comparative cable S was troublesome due to difficulties in controlling the dimension, especially in term of circularity of the cross-section, and in obtaining a smooth surface. Also, the cable did not pass impact resistance test.

In order to evaluate the multipolar cables prepared in Table 1, impact, flame, flexibility and crush tests were conducted.

Impact tests. The effect of impacts on a cable was evaluated by an impact test based on the standard IEC61901 ($1^{st}$ edition, 2005-07). The effects of an impact at various forces (J) were evaluated by means of measuring the depth of damage (mm). The cables were subjected to impact levels of 25 J to 70 J or to more severe conditions (from 150 J to 300 J) depending on their intended use. The depth of damage gives an indication of the degree of protection provided by the expanded impact resistant layer. Tables 2a and 2b set forth the values of the various energy levels analysed, depth of damage (mm) measured for samples A-F and M-Q.

TABLE 2a

| Impact Strength Test Results | | | | | | |
|---|---|---|---|---|---|---|
| | Energy Levels | | | | | |
| Cable | 25J | 30J | 40J | 50J | 60J | 70J |
| A | 0.63 | 0.67 | 0.88 | 0.96 | 0.86 | 0.98 |
| E* | 0.53 | 0.76 | 0.91 | 1.18 | 1.18 | 1.26 |
| F* | 6.61 | 0.42 | 0.85 | 1.06 | 1.24 | 1.25 |
| M | 0.21 | 0.29 | 0.27 | 0.61 | 0.49 | 0.64 |
| N | 0.59 | 0.70 | 0.63 | 0.85 | 1.03 | 0.91 |
| O | 0.60 | 0.80 | 0.70 | 0.75 | 0.85 | 1.04 |
| P | 0.59 | 0.57 | 0.80 | 0.69 | 1.02 | 0.84 |
| Q | 0.41 | 0.59 | 0.84 | 0.72 | 0.94 | 0.84 |

TABLE 2b

| Impact Strength Test Results | | | | |
|---|---|---|---|---|
| | Energy Levels | | | |
| Cable | 150J | 200J | 250J | 300J |
| B | 1.27 | 1.64 | 0.87 | 1.42 |
| C | 0.56 | 1.18 | 1.02 | 1.11 |
| D | 0.44 | 0.60 | 1.31 | 1.45 |

This testing shows that the cables according to the invention resisted to impact in a way at least comparable to that of armoured cable E and F.

Other tests: The flexibility and the effects of flame and crushing on certain multipolar cables were also evaluated. The flame test is a pass/fail test that follows the IEEE-1202 standard for 60 inch (about 1.5 m) length. The flexibility test is a three point bend test, recorded at 1% secant modulus according to ASTM D-790. The crush test applies the procedure of UL-1569 setting 5340N (1200 lbfas minimum load, and the table reports the maximum load bore by the cables. Table 3 gives the values for these test results.

TABLE 3

| Flame, Flexibility, Crush Test Results | | | |
|---|---|---|---|
| Cable | Flame | Flexibility (MPa) | Crush (N) |
| A | Pass | 91.0 | 5430 |
| E* | — | 338.0 | 14100 |
| M | Pass | 114.0 | 6400 |
| Q | Pass | 101.0 | 5750 |

This testing shows that the cables of the invention performed favorably when compared to prior art cables. Their crush resistance is according to the standard requirements and goes along with a remarkably improved flexibility and to the capability of withstanding flame.

The cables of the invention provide a solution for a cable which is light weight, flexible, impact resistant, crush resistant, flame resistant and chemical resistant.

What is claimed is:

1. An impact resistant multipolar power cable comprising, a) a plurality of cores, each core comprising at least one conductive element and an electrical insulating layer in a position radially external to the at least one conductive element, the cores being stranded together so as to form an assembled element providing a plurality of interstitial zones;

b) an expanded polymeric filler filling the interstitial zones, and comprising a polymer with a shore D hardness ranging from 30 to 70, a flexural modulus of from 50 MPa to 1500 MPa at 23° C., and a LOI of from 27 to 95% before expansion, wherein the expanded polymeric filler contains expanded microspheres;

c) an impact resistant layer in a position radially external to and in contact with the expanded polymeric filler, wherein the layer comprises an expanded polymer that differs from the polymer for the filler and has, before expansion, a flexural modulus greater than that of the polymer for the filler; and d) a solid polymeric jacket surrounding the impact resistant layer.

2. The cable according to claim 1, wherein the expanded polymeric filler comprises polymers chosen from thermoplastic vulcanizates (TPV), thermoplastic olefins (TPO), flame retardant polypropylene, polyvinylchloride (PVC), polyvinylidene fluoride (PVDF), and combinations thereof.

3. The cable according to claim 1, wherein the expanded polymeric filler has an expansion degree ranging from 15% to 200%.

4. The cable according to claim 3, wherein the expanded polymeric filler has an expansion degree ranging from 25% to 100%.

5. The cable according to claim 1, wherein the impact resistant layer comprises a polymer chosen from polyvinylidene fluoride (PVDF), polypropylene (PP), polyethylene (PE), and mixtures thereof.

6. The cable according to claim 1, wherein the impact resistant layer has an expansion degree ranging from 20% to 200%.

7. The cable according to claim 6, wherein the impact resistant layer has an expansion degree ranging from 20% to 50%.

8. The cable according to claim 1, wherein the impact resistant layer contains expanded microspheres.

9. The cable according to claim 1, wherein both the expanded polymeric filler and the impact resistant layer contain expanded microspheres.

10. The cable according to claim 1, further comprising a chemical barrier layer.

11. The cable according to claim 1, wherein the expanded polymeric filler fills the interstitial zones and forms an annular layer overlaying the interstitial zones and the stranded cores.

12. The cable according to claim 11, wherein annular layer has a thickness of about 1 mm to about 6 mm.

13. Process for producing an impact resistant multipolar power cable comprising a plurality of cores, each core comprising at least one conductive element and an electrical insulating layer in a position radially external to the at least one conductive element, the cores being stranded together so as to form an assembled element providing a plurality of interstitial zones; an expanded polymeric filler filling the interstitial zones; an impact resistant layer in a position radially external to and in contact with the expanded polymeric filler; and a solid polymeric jacket surrounding the impact resistant layer, the processing comprising:

a) providing to an extruder a first polymer material with a shore D hardness ranging from 30 to 70, a flexural modulus of from 50 MPa to 1500 MPa at 23° C., and a LOI of from 27 to 95% for producing the expanded polymeric filler;

b) providing to an extruder a second polymer material for producing the impact resistant layer, said second polymer having a flexural modulus greater than that of the first polymer;

c) adding a foaming agent to the first and second polymer material, the foaming agent for at least the first polymer being thermally expandable microspheres;

d) triggering the foaming agent of the first and second polymer material to expand the relevant polymer;

e) coextruding the expanded first and second polymer material to form the polymeric filler filling the interstitial zones and the impact resistant layer; and f) extruding a solid polymeric jacket around the impact resistant layer.

14. Process according to claim 13, wherein the foaming agent for the second polymer comprises thermally expandable microspheres.

* * * * *